US010058976B2

(12) United States Patent
Stamey

(10) Patent No.: US 10,058,976 B2
(45) Date of Patent: Aug. 28, 2018

(54) HARDBANDING REMOVAL DEVICE AND METHOD

(71) Applicant: ATT Technology, Ltd., Stafford, TX (US)

(72) Inventor: Elliot Morgan Stamey, Houston, TX (US)

(73) Assignee: ATT Technology, Ltd., Houston, TX (US)

( * ) Notice: Subject to any disclaimer, the term of this patent is extended or adjusted under 35 U.S.C. 154(b) by 81 days.

(21) Appl. No.: 15/349,724

(22) Filed: Nov. 11, 2016

(65) Prior Publication Data

US 2018/0133864 A1 May 17, 2018

(51) Int. Cl.

| | |
|---|---|
| ***B24B 21/18*** | (2006.01) |
| ***B24B 49/04*** | (2006.01) |
| ***B24B 5/04*** | (2006.01) |
| ***B24B 5/35*** | (2006.01) |
| ***E21B 17/10*** | (2006.01) |

(52) U.S. Cl.

CPC ..... *B24B 49/04* (2013.01); *B24B 5/04* (2013.01); *B24B 5/355* (2013.01); *E21B 17/1085* (2013.01)

(58) Field of Classification Search

CPC ..... B24B 21/18; B24B 21/02

USPC ..... 451/28, 49, 439, 348, 209, 210, 5

See application file for complete search history.

(56) References Cited

U.S. PATENT DOCUMENTS

| | | | | |
|---|---|---|---|---|
| 2,600,481 | A * | 6/1952 | Clyde | B24B 5/04 409/140 |
| 3,052,067 | A | 9/1962 | Dilks | |
| 3,552,066 | A | 1/1971 | Gladstone | |
| 3,608,246 | A | 9/1971 | McCormack | |
| 3,641,709 | A | 2/1972 | Gazuit | |
| 4,031,669 | A | 6/1977 | Koide | |
| 4,121,384 | A | 10/1978 | Harmant | |
| 4,194,031 | A * | 3/1980 | Cullum | E21B 17/1085 138/109 |

(Continued)

FOREIGN PATENT DOCUMENTS

| | | |
|---|---|---|
| CN | 104440487 | 3/2015 |
| DE | 2336276 C2 | 11/1982 |

(Continued)

OTHER PUBLICATIONS

Alliance Hardbanding Grinder Demo, https://www.youtube.com/watch?v=djTOfC_iGbl, Published on Jun. 27, 2012, 1 page.

(Continued)

*Primary Examiner* — Robert Rose

(74) *Attorney, Agent, or Firm* — Clark Hill Strasburger

(57) ABSTRACT

The disclosure relates to a hardbanding removal apparatus and method for use with oilfield tubulars and downhole tools. The apparatus includes a tiltable frame with support arm, a grinding wheel coupled to the support arm, and an idler wheel assembly to supply mechanical feedback to the grinding wheel through the support arm. The mechanical feedback allows the grinding wheel to remove hardbanding accurately and uniformly on tubulars that are eccentric, curved, or have eccentric hardbanding. The tiltable frame enables grinding of tapered sections of the tubular without reorienting the tubular. The method includes removing hardbanding using the apparatus.

8 Claims, 7 Drawing Sheets

(56) References Cited

U.S. PATENT DOCUMENTS

| | | | | |
|---|---|---|---|---|
| 4,248,019 | A | 2/1981 | Hawley | |
| 4,262,455 | A | 4/1981 | Rettew | |
| 4,453,348 | A | 6/1984 | Konstantin | |
| 4,627,196 | A | 12/1986 | Veale | |
| 4,679,355 | A | 7/1987 | Evertz | |
| 5,224,559 | A | 7/1993 | Arnoldy | |
| 5,531,635 | A | 7/1996 | Mogi | |
| 6,375,895 | B1 | 4/2002 | Daemen | |
| 7,845,434 | B2 | 12/2010 | Clayton | |
| 8,714,259 | B2 | 5/2014 | Orban | |
| 8,926,407 | B2 * | 1/2015 | Lewkoski | B08B 9/023 15/179 |
| 2012/0067563 | A1 | 3/2012 | Jellison | |
| 2016/0076314 | A1 | 3/2016 | Begnaud | |

FOREIGN PATENT DOCUMENTS

| | | |
|---|---|---|
| FR | 2389454 | 12/1978 |
| WO | 8404480 | 11/1984 |
| WO | 9408747 | 4/1994 |
| WO | 0110597 | 2/2001 |

OTHER PUBLICATIONS

Coffey Manufacturing: OD Grinding Machine, https://vimeo.com/78582925, Published 3 years ago, Coffey Mfg., LLC OD Grinding Machine, 711 Majors Ct. Bakersfield, CA 93308, 1 page.

Form PCT/ISA/210, Patent Cooperation Treaty (PCT) International Search Report dated Dec. 11, 2017 for International Patent Application No. PCT/US2017/047211 (including the Search History Document), 8 pages.

Form PCT/ISA/237, Patent Cooperation Treaty (PCT) Written Opinion of the International Searching Authority dated Dec. 11, 2017 for International Patent Application No. PCT/US2017/047211, 5 pages.

* cited by examiner

HARDBANDING REMOVAL DEVICE AND METHOD

BACKGROUND OF THE DISCLOSURE

1. Field of Disclosure

The present disclosure relates to preparation of drill pipes for subterranean drilling operations, and specifically for removal of hardbanding material from the surface of drill pipes and other downhole components.

2. Description of the Related Art

Drill pipes used in subterranean operations are subject to abrasion, erosion, and damage from impacts against hard walls of a borehole, as well as debris encountered during drilling. In order to protect the outer surface of the drill pipes, a protective layer of hard material, called hardfacing (or a hardfacing alloy), may be added to the outer surface to prevent or reduce abrasive wear of the drill pipes and other downhole components. The hard material, such as tungsten carbide, that acts as the protective layer and is called hardbanding once applied to the drill pipes. The hardbanding protects the face of the softer surface of the drill pipes or other downhole components.

During drilling operations, previously applied hardbanding may be damaged or worn down and require replacement or repair. In order for new hardbanding to be applied, some or all of the existing hardbanding must be removed from the drill pipe and other downhole components. In order for the hardbanding to be removed, the drill pipe must be removed from the borehole so that a grinding system has access to the hardbanding.

Problems can occur when drill pipe and other downhole tools are being reconditioned with hardbanding due to uneven erosion of existing hardbanding, improper application during the original hardbanding, and eccentricity of the drill pipe or other downhole tools due to manufacturing or operational damage.

A shortcoming of existing hardbanding removal systems is that the uneven hardbanding, either due to wear or original installation, that results in high and low spots on the surface of the drill pipe such that the hardbanding cannot be easily removed by grinding the same depth of hardbanding around the circumference of the drill pipe. Grinding the same depth results in either under grinding of high spots leaving drill pipe with incomplete removal of the hardbanding or over grinding of low spots damaging the drill pipe.

Another shortcoming of existing hardbanding removal systems is that a tubular eccentricity can result in uneven removal of the hardbanding because the surface of the drill pipe, when rotated around its longitudinal axis, results in the distance between the surface of the drill pipe and the grinding wheel changing as the drill pipe is rotated, leading to either incomplete removal, damage to the drill pipe, or both. Problems are also presented when the surface of the drill pipe is curved out of shape from a straight tubular.

Another shortcoming of existing hardbanding removal systems is that they do not compensate for pipe "walk" when the rotating tubular is exposed to the forces of grinding during hardbanding removal. The drill pipe may move longitudinally relative to the grinder due to the grinding pressure, which reduces accuracy, results in uneven hardbanding removal, and causes delays and rework.

Another shortcoming of existing hardbanding removal systems is that correction of under and over grinding may be performed manually or with hand grinders, which increases the time, cost, and uniformity of hardbanding removal. Further, manual and hand grinding has low accuracy with regard to depth of cut and low consistency along the length of a hardbanded surface.

What is needed is a hardbanding removal system that removes hardbanding without under grinding or over grinding when presented by uneven hardbanding deposits and tubular eccentricities.

BRIEF SUMMARY OF THE DISCLOSURE

In aspects, the present disclosure is related to an apparatus and method for preparing drill pipe, and, in particular, removing hardbanding material from the surface of drill pipe.

One embodiment according to the present disclosure includes an apparatus, comprising: a front plate; a support arm coupled to the front plate; a linkage extending from the support arm; a grinding wheel supported by the support arm; an idler wheel assembly comprising: a first structural element having a first end and a second end and coupled to the support arm along an edge between the first end and the second end; a second structural element having a first end and a second end, where the first structural element is coupled at about its first end to the second structural element at about its first end; a third structural element having a first end and a second end, where the first structural element is coupled at about its second end to the third structural element at about its first end and where the second structural element is coupled at about its second end to the third structural element at about its second end; a distance adjustment element that screwably engaging the third structural element on its first end, wherein the adjustment of the distance adjustment element changes a distance between the second end of the first structural element and the second end of the second structural element; an idler wheel coupled to the first end of the third structural element; a piston rod coupled on a first end with the linkage; and a shock absorber slidably engaging a second end of the piston rod and coupled to the support arm. The apparatus may also include a linear actuator disposed between and coupled to the front plate and the linkage. The linear actuator may include a linear actuator base; and a linear actuator extension bar, wherein the linear actuator extension bar slideably engages and linear actuator base, which if configured to receive at least part of the linear actuator extension bar. The apparatus may also include a back plate disposed parallel to the front plate; and a fastener or fastening means coupling the front plate to the back plate, wherein the front plate is rotatable relative to the back plate around the axis of the fastener. The shock absorber may include a pneumatic piston. The apparatus may also include a frame supporting the front plate and a work piece. An anti-walk wheel may be coupled to the frame and disposed to oppose lateral movement of the work piece. A lateral track may be disposed on the frame, wherein the front plate is coupled to the lateral track and may slide relative along the lateral track.

Another embodiment according to the present disclosure includes a method for removing hardbanding from a work piece, the method comprising: tracing a contour of a work piece surface having a hardbanding covered section and a bare section; determining a grinding depth based on the traced contour; and grinding the work piece to the determined depth using a grinding wheel. The method may also include, where the work piece is a tubular with a longitudinal axis, rotating the work piece around its longitudinal axis while grinding. The method may include orienting the grinding wheel relative to the work piece. The method may include laterally positioning the grinding wheel relative to the work piece while the work piece is laterally stationary. The method may include preventing lateral movement of the work piece in at least one lateral direction during grinding.

BRIEF DESCRIPTION OF DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

Figure 1A:
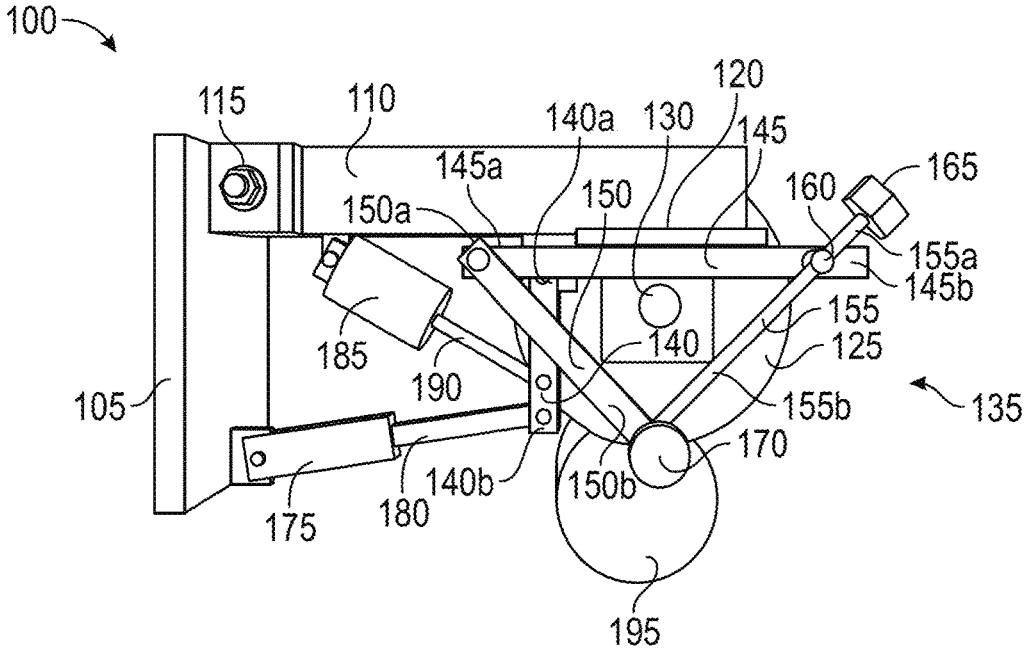
FIG. 1A shows a side view diagram of a hardbanding removal device according to one embodiment of the present disclosure.

Generally, the present disclosure relates to preparation of a drill pipe for subterranean operations. Specifically, the present disclosure is related to removing hardbanding from oilfield tubulars and pipes.

There are shown in the drawings, and herein will be described in detail, specific embodiments of the present disclosure with the understanding that the present disclosure is to be considered an exemplification of the principles of the present disclosure and is not intended to limit the present disclosure to that illustrated and described herein.

Figure 1B:
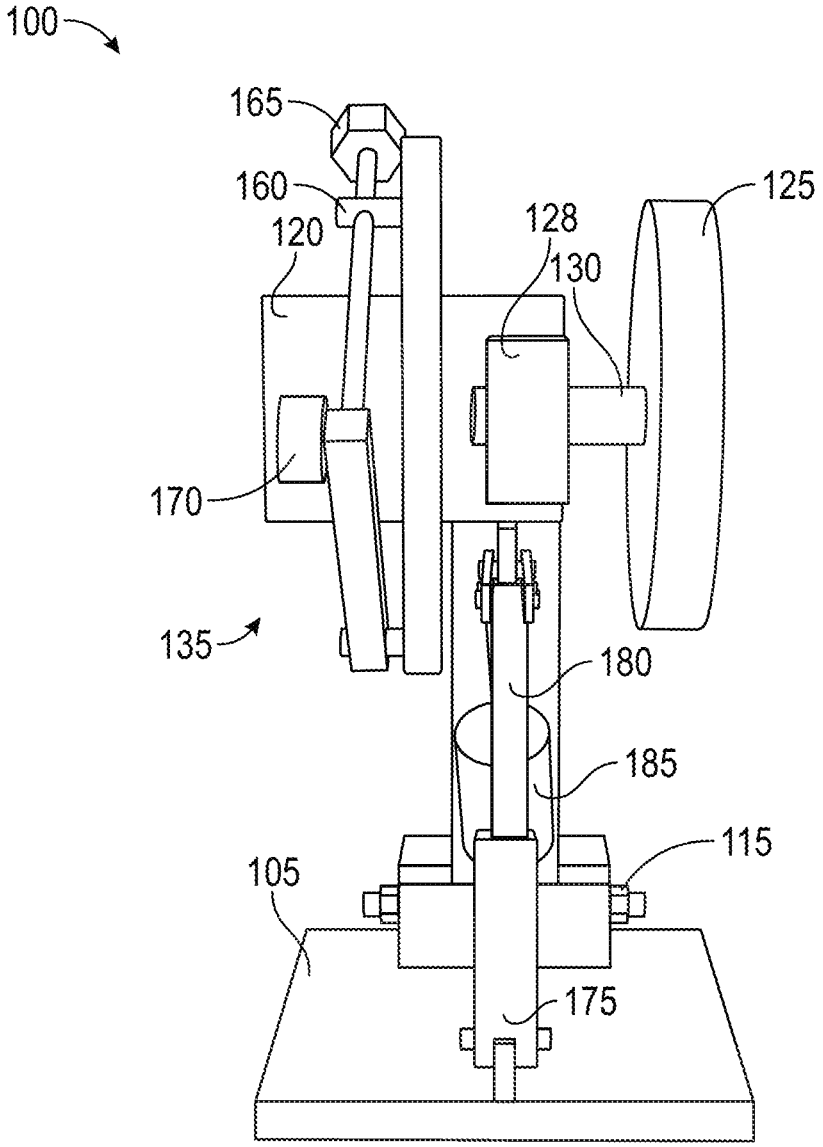
FIG. 1B shows a bottom view diagram of the hardbanding removal device of FIG. 1A.
Figure 1C:
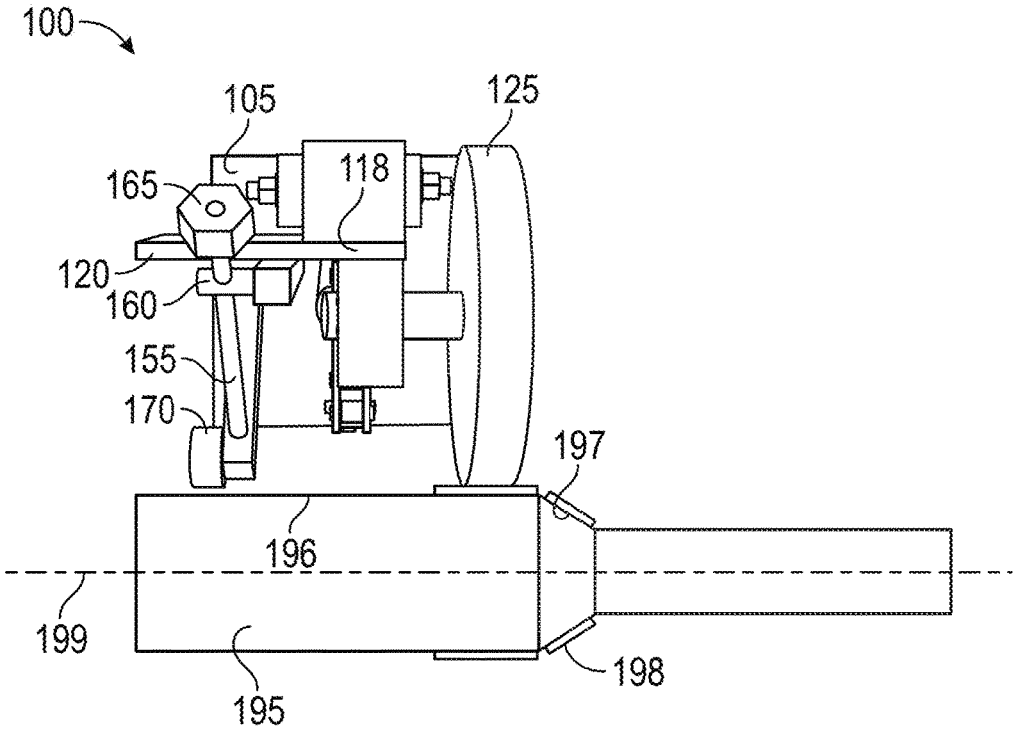
FIG. 1C shows a front view of the hardbanding removal device of FIG. 1A.

FIGS. 1A-1C shows a hardbanding removal apparatus 100 according to one embodiment of the present disclosure. FIG. 1A shows the apparatus 100 from the side, and the apparatus 100 may include a front plate 105 and a support arm 110. The support arm 110 is coupled to the front plate by a fastener 115 such as a threaded bolt secured with nut on each side of the bolt or a threaded bolt with a head and nut on one side. The bolt and nut combination 115 is exemplary and illustrative only, as other fasteners may be used as would be understood by a person of ordinary skill in the art, such as rivets or welding. The front plate 105 includes an attachment point (not shown) so that the support arm 110 may be coupled to the front plate with the fastener 115. In some embodiments, the fastener 115 is selected to act as a hinge so that the support arm 110 may pivot up and down in relation to the front plate 105. A grinding wheel support element 120 is coupled to the support arm 110 and a grinding wheel driver motor 128 is coupled to the grinding wheel support element 120. The grinding wheel driver motor 128 includes an opening for receiving a spindle 130 of a grinding wheel 125. The grinding wheel 125 may be made of any material that is suitable for grinding hardbanding. Typically, a grinding wheel 125 must be made of a composite material that can effectively grind materials with the hardness of tungsten carbide. The grinding wheel support element 120 may be coupled to the support arm 110 by another fastener 118, which may be the same or different from the fastener 115. A linkage 140 may be coupled to the support arm 110. The linkage 140 may extend vertically downward from the support arm 110. The linkage 140 may be elongated and has a first end 140*a* and a second end 140*b*. The linkage 140 is coupled at or near a first end 140*a* to the underside of the support arm 110. Also coupled to the grinding wheel support element 120 is an idler assembly 135.

The idler assembly 135 comprises a first structural element 145, a second structural element 150, a third structural element 155, connecting pins 160, a distance adjustment element 165, and an idler wheel 170. Each of the structural elements 145, 150, 155 is elongated and may be rectangular, cylindrical, or tubular or other suitable shape. The idler assembly 135 must be sufficiently robust to, upon engagement of the idler wheel 170 with a work piece 195, to provide mechanical force feedback to the support arm 110 in order to adjust the depth of cut of the grinding wheel 125. The work piece 195, such as a segment of steel drill pipe with hardbanding, is positioned relative to the apparatus 100 so that the hardbanding removal may be performed. The grinding wheel 125 and the idler wheel 170 are positioned so that both are in contact with an outer surface of the drill pipe 195. In some embodiments, the grinding wheel 125 may be raised or lowered using the fasterner 115 between the support arm 110 and the front plate 105 as a hinge so that drill pipes 195 with different diameters may be accommodated by the apparatus 100.

The first structural element 145 extends horizontally and is coupled to the grinding wheel support element 120 along one horizontal edge. The first structural element 145 has a first end 145*a* and a second end 145*b*, which are substantially equidistant from the spindle 130. The second structural element 150 includes a first end 150*a* and a second end 150*b*. The first structural element 145 is coupled to the second structural element at or near the first end 150*a* and at or near the first end 145*a* of the first structural element 145. The idler wheel 170 is disposed on the second end 150*b*. The third structural element 155 includes a first end 155*a* and a second end 155*b*. The third structural element 155, at or near the first end 155*a*, is coupled to the first structural element 145 at or near the second end 145*b*. The third structural element 155, at the second end 155*b*, also coupled to the first structural element 145 at or near the second end 145*b*. A distance adjustment element 165 may be disposed at the first end 155*a* for controlling the depth of cut of the grinding wheel 125. The distance adjustment element 165 is adjustable along a threaded section of the third structural element 155, and turning of the nut 165 along the threads changes the distance between the second end 145*b* and the second end 150*b*.

Adjusting the distance between the first structural element 145 and the third structural element 155 changes position of the idler wheel 170 relative to the support arm 110 and determines when the idler wheel 170 will engage the work piece 195 during grinding. The distance adjustment element 165 may be controlled manually or by an automated actuator, such as a stepper motor. The distance adjustment element 165 may be used to set the depth of the cut of the grinding wheel to compensate for wear on the grinding wheel 125. The distance adjustment element 165 may be used to control whether the hardbanding is removed partially, flush with the surface of the work piece 195, or below grade for the surface of the work piece 195. One exemplary distance adjustment element 165 is a threaded nut that is adjustable along the threaded section of the third structural element 155. The use of a nut is exemplary and illustrative only, as any suitable distance adjustment element known to one of ordinary skill in the art may be used. In some embodiments, a sensor (not shown) may detect contact between the idler wheel 170 and the work piece 195, and, based on a signal from the sensor, the distance adjustment element 165 may be adjusted.

The first structural element 145, the second structural element 150, and the third structural element 155 are arranged to form, substantially, a single plane. The connecting pins 160 between the first structural element 145, the second structural element 150, and the third structural element 155 may be shafts with locking nuts, rivets, or other suitable coupling means that allow the first structural element 145, the second structural element 150, and the third structural element 155 to change orientation relative to one another within the single plane. Thus, one or more of the connecting pins 160 may couple two of the structural elements 145, 150, 155 and rotate when the shape of the idler assembly 135 changes due to movement of the structural members 145, 150, 155 with relation to each other. For example, the third structural element may penetrate the connecting pin 160 attached at the second end 145*b* of the first structural element 145 as shown in FIG. 1B. FIG. 1B shows a bottom view of the apparatus 100 without a work piece 195. When the distance between the second end 145*b* and the second end 150*b* is changed by adjusting the distance adjustment element 165, the connector pin 160 rotates so that the first structural element 145 and the third structural element 155 remain coupled but the angle between the first structural element 145 and the third structural element 155 is allowed to change.

The linkage 140 is coupled to a two-part linear actuator comprising a linear actuator base 175 and linear actuator extension bar 180. The linear actuator base 175 is partially hollow and configured to receive and slidably engage at least part of the linear actuator extension bar 180 in order to adjust the overall length of the combined linear actuator base 175 and linear actuator extension bar 180. A lockable connector between the linear actuator base 175 and the linear actuator extension bar 180 allows the overall length of the combination 175, 180 to be adjusted and then locked into position. The linear actuator base 175 is coupled the front plate 105 by a rivet or other suitable coupler that allows rotational motion about the coupling point. The linear actuator extension bar 180 is coupled to the linkage 140 at or near the second end 140*b*. In some embodiments, an actuator may slide the linear actuator base 175 or the linear actuator extension bar 180 relative to the other to set the coarse positioning of the grinding wheel 125 relative to the work piece 195.

The linkage 140 is also coupled to a shock absorber 185 and a piston rod 190. The shock absorber 185 is coupled to the underside of the support arm 110 and configured to receive the piston rod 190. The piston rod 190 is also coupled to the linkage 140 at or near the second end 140*b*. The shock absorber 185 may include a pneumatic or hydraulic cylinder such that pressure within the shock absorber 185 may be adjusted to control tension on the piston rod 190, which provides mechanical lift to compensate for the hanging weight of the to the grinding wheel 125 and support arm 110, making it easier to for the operator to control. The pressures in the shock absorber 185 on either side of an internal piston may be adjusted to control the weight of the grinding wheel 125 applied to the work piece 195. Thus, the grinding force may be controlled by the pressure regulation of the shock absorber 185. The pressures in the shock absorber 185 may be manually controlled by an operator or with the assistance of an automatic feedback loop including a pressure sensor to measure the pressure applied by the grinding wheel 125 to the work piece 195 as would be understood by a person of ordinary skill in the art. At least one of the pressures in the shock absorber 185 may be controlled by a stepper motor (not shown) configured to increase/decrease the pressure value.

The shock absorber 185 also dampens vibration due to the cutting of the work piece 195 by the grinding wheel 125 and due to any bouncing caused by adjustment of the grinding wheel 125 by the operator or caused by rotation of the work piece 195. Precise control of the pressure of the grinding wheel 125 on the work piece 195 and dampening of vibrations and oscillations during grinding allow the system 100 to grind to a higher degree of accuracy and with tighter tolerances. Further, the precision and accuracy due to the idler wheel 170 feedback and vibration dampening of the shock absorber 185 allow the drill pipe 195 to be rotated at speeds on the order of 20 to 100 rpm without losing accuracy and precision of cutting, especially when the drill pipe 195 and/or hardbanding 196 is eccentric. By rotating the work piece 195 at higher speeds, the amount of grinding time on any one point of the work piece surface is reduced, and heat that is built up during the grinding process can be dissipated. Thus, the higher speed of rotation of the work piece 195 reduces the likelihood of melting of the work piece 195 during the hardbanding removal process. The precision and vibration dampening also allows the operator to reliably remove hardbanding to the same depth while moving longitudinally along the surface of the work piece 195, thus ensuring at smooth final surface. The final surface can be uniform with a consistent grinding depth that is one of: a reduced layer of hardbanding, a bare pipe, or a below grade surface.

As shown, the piston rod 190 is connected to the linkage 140 further from the second end 140*b* than the support bar 180 is connected to the linkage 140; however, this is illustrative and exemplary only, as the piston rod 190 may be connected to the linkage 140 closer to the second end 140*b* than the support bar 180.

FIG. 1C shows a front view of the apparatus 100 engaging the work piece 195, which is shown in more detail. The exemplary work piece 195 is a drill pipe with a longitudinal axis 199, an outer surface 196 that is parallel to the longitudinal axis 199, and a tapered section 197. Hardbanding material 198 is shown on both the outer surface 196 and the tapered section 197.

Figure 2A:
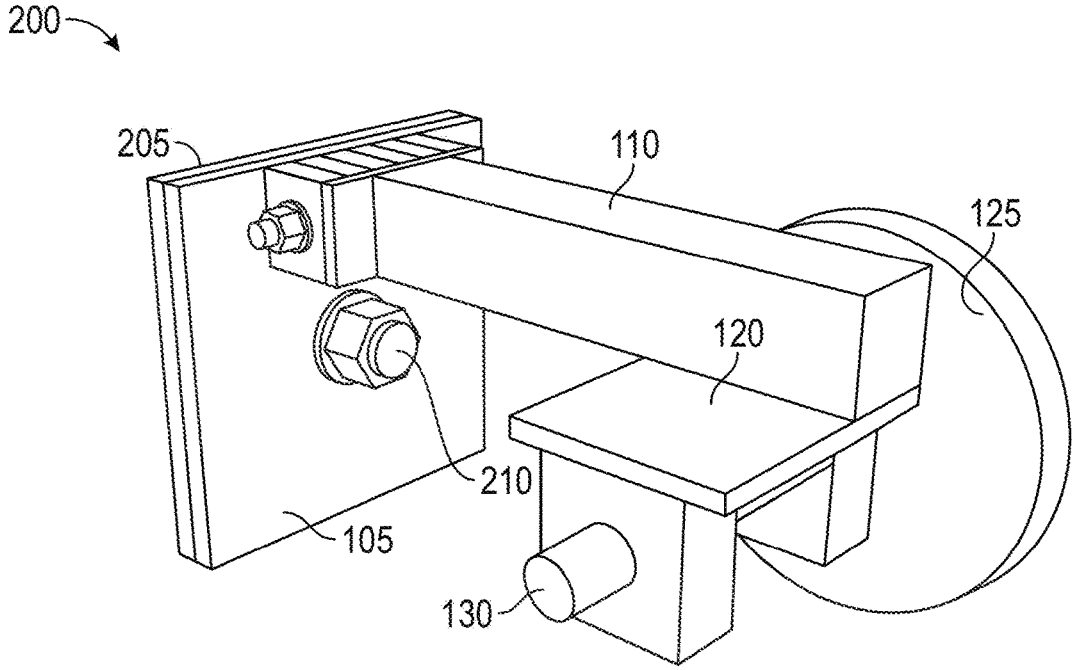
FIG. 2A shows a diagram of a tilt arm system coupled to the hardbanding removal system of FIG. 1A in an untilted orientation.

FIG. 2A shows a diagram of the apparatus 100 without the idler assembly 135 so that a tilt arm system 200 can be viewed. The tilt arm system 200 includes a back plate 205 and a coupler 210, such as a bolt and nut combination. The coupler 210 couples the back plate 205, which is fixed, to the front plate 105 of the apparatus 100. The coupler 210 may act as a combination attachment point and axle for the front plate 105 by both supporting the grinding wheel 125 and support arm 110 and also by allowing the front plate 105 to be reoriented while remaining parallel to the back plate 205. As shown in FIG. 2A, the front plate 105 and the back plate 205 are oriented in an untilted position. When the coupler 210 is loosened, the front plate 105 can be swiveled relative to the back plate 205 about the axis formed by the coupler 210. By swiveling the front plate 105, the apparatus 100 may be tilted to position the grinding wheel 125 and the idler wheel 170 relative to the work piece 195. In some embodiments, the coupler 210 may include a bearing (not shown) to allow the front plate 105 to rotate freely without transmitting torque to the coupler 210. The bolt and nut combination is exemplary and illustrative only, as other couplers suitable for attaching the back plate 205 to the front plate 105 known to a person of ordinary skill in the art may be used, such as a shaft with a spin locking mechanism. In some embodiments, the coupler 210 may be releasable so that the front plate 105 may be reoriented relative to the back plate 205 and then locked in a new orientation (e.g. tilted); however, is also contemplated that the coupler 210 may not allow tilting of the front plate 105 but instead rigidly connect to the back plate 205.

Figure 2B:
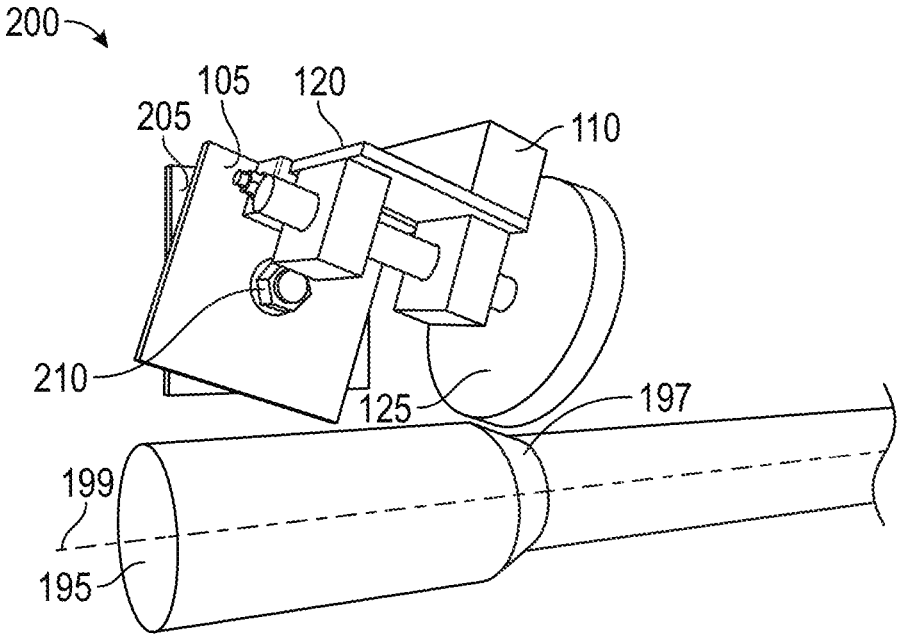
FIG. 2B shows a diagram of a tilt arm system coupled to the hardbanding removal system of FIG. 1A in a tilted orientation.

FIG. 2B shows a diagram of the apparatus 100 and the tilt arm system 200 in a tilted position. The front plate 105 has been rotated on the coupler 210 so that the surface of the grinding wheel 125 is oriented to engage the tapered section 197.

Figure 3:
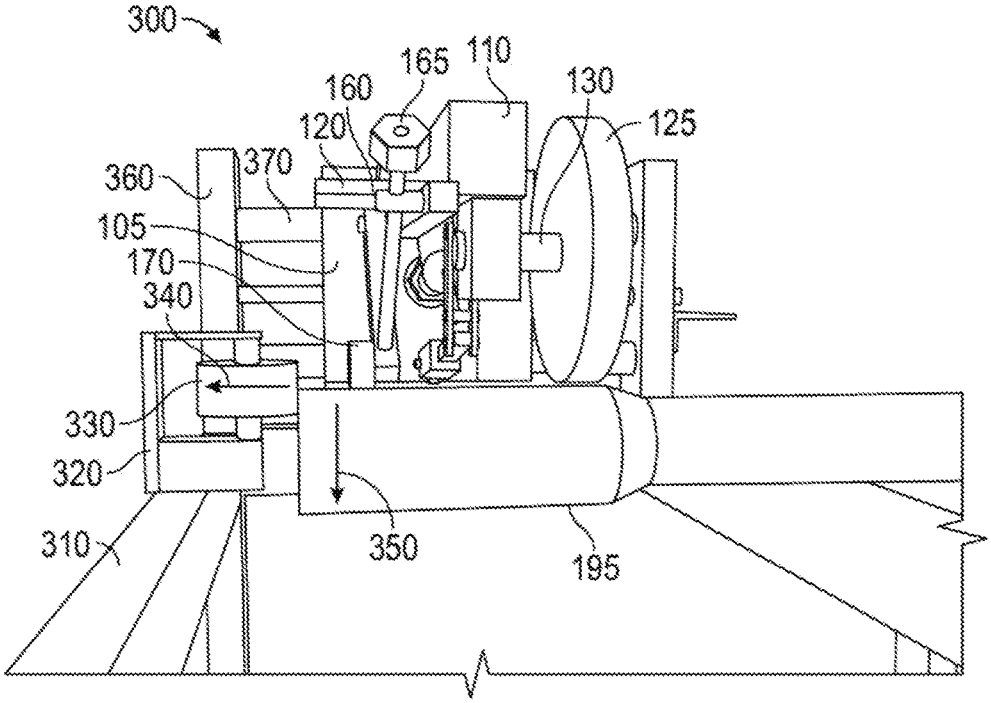
FIG. 3 shows a diagram of the hardbanding removal device of FIG. 1A with an anti-walk wheel according to another embodiment of the present disclosure.

FIG. 3 shows a 3D diagram of a hardbanding removal system 300 engaging the work piece 195. The system 300 includes the apparatus 100 and the tilt arm system 200 and also includes a frame 310 for supporting the apparatus 100, the tilt arm system 200, and the work piece 195. The work piece 195 may be rotated on its longitudinal axis while remaining on the frame 310. An anti-walk wheel frame 320 may be disposed on the frame 310 and hold an anti-walk wheel 330. The anti-walk wheel is positioned on the frame 310 to engage an end of the work piece 195. During grinding, the grinding force may cause the work piece 195 to move laterally on the frame 310 or "walk." To prevent uneven grinding and walking of the work piece 195, the anti-walk wheel 330 is positioned to impede the lateral movement of the work piece 195 in at least one direction. Since the work piece 195 may be rotating in the direction of arrow 350, the anti-walk wheel 330 is coupled to the anti-walk wheel frame 320 so that the anti-walk wheel 330 may rotate in the direction of arrow 340. Thus, the angular movement of the work piece 195 is translated into angular movement of the anti-walk wheel 340 rather than moving the work piece 195 toward or away from the apparatus 100.

The apparatus 300 also includes vertical supports 360 disposed on the frame 310 with lateral tracks 370. The back plate 205 may be mounted on the lateral tracks 370 so that the apparatus 100 and the tilt arm system 200 may move laterally along the lateral tracks 370 during a grinding operation. This means that the grinding wheel 125 can be moved along the work piece 195 longitudinally without repositioning the work piece 195. The grinding wheel 125 may be moved from a first lateral position to a second lateral position relative to the work piece 195 in either a discrete or a continuous movement. Lateral control, either discrete or continuous, allows the operator to remove hardbanding 198 from the outer surface 196 uniformly and to a precise depth. Combining continuous lateral movement with the idler wheel 170 feedback to the grinding wheel 125 increases the uniformity of the outer surface 196 after grinding.

Figure 4:
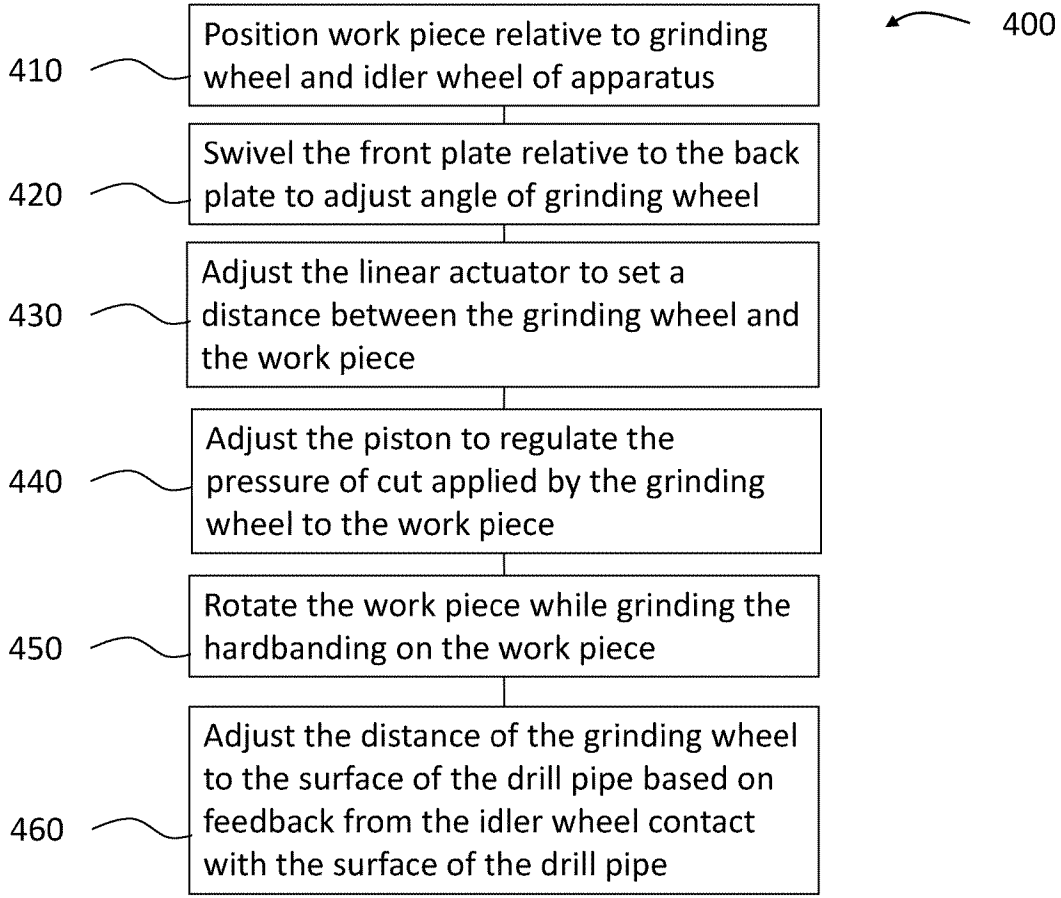
FIG. 4 shows a flow chart of a method for removing hardbanding according to one embodiment of the present disclosure.

FIG. 4 shows a flow chart of a method 400 for removing hardbanding using the apparatus 100. In step 410, the work piece 195, such as a drill pipe, is positioned near the grinding wheel 125 and the idler wheel 170 of the apparatus. In step 420, the front plate 105 is swiveled relative to the back plate 205 to change the orientation of the grinding wheel 125 so that the edge of the grinding wheel 125 is perpendicular with the surface of the work piece 195 (even when perpendicular with the work surface is not perpendicular to the longitudinal axis of the work piece 195). Thus, in instances where the work piece 195 is tapered, the front plate 105 may be reoriented to grind along the tapered surface 197 and then reoriented again grinding of the outer surface 196 that substantially parallel with the longitudinal axis of the work piece 195. This means that the hardbanding 198 may be removed from the surfaces 196, 197 of the work piece 195 without the work piece being repositioned. In some embodiments, step 420 is optional, such as when the work piece 195 does not have a tapered surface with hardbanding to be removed. In step 430, the linear actuator base 175 and linear actuator extension bar 180 may be adjusted so that the grinding wheel 125 and the idler wheel 170 are both in contact with the outer surface 196 of the work piece 195. The adjustment of the grinding wheel 125 and the idler wheel 170 may be performed manually or automatically. The idler wheel 170 may have a sensor to indicate when contact between the idler wheel 170 and the work piece 195 occurs. Steps 420 and 430 may be repeated to refine the positioning of the grinding wheel 125 and the idler wheel 170 with the outer surface 196 of the work piece 195. In step 440, the pressure in a first chamber of the shock absorber 185 is adjusted relative to the pressure in a second chamber of the shock absorber 185 to apply a specific amount of tension on the piston rod 190 to compensate for the hanging weight of the grinding wheel 125 and to apply cutting pressure on the outer surfaces 196 of the work piece 195. In step 450, the work piece 195 is rotated around its longitudinal axis 199 so that a contact point between the outer surface 196 of the work piece 195 and the grinding wheel 125 moves circumferentially along the outer surface 196 of the work piece 195. In step 460, the position of the contact point between the outer surface 196 of the work piece 195 is adjusted by pressure between a contact point between the idler wheel 170 and the outer surface of the work piece 195. Typically, the idler wheel 170 is make contact with the surface of the work piece 195 that does not include hardbanding 198, so that it may trace the bare surface contours of the outer surface as the work piece 195 is rotated. Since the work piece may not be perfectly circular, any ovaling or eccentricity of the work piece 195 will apply additional pressure against the idler wheel 170 as the distance between the outer surface of the work piece 195 and the center of rotation of the work piece 195 vary during rotation. This pressure on the idler wheel 170 is transmitted through the idler assembly 135 to change the distance between the grinding wheel 125 and the outer surface of the work piece 195. Thus, the hardbanding 198 may be removed from the surface of the work piece 195 evenly at a depth determined by the contour traced by the idler wheel 170, especially in circumstances where the work piece 195 is a tubular that has an eccentric shape rather than a circular one, where the hardbanding on the surface of the work piece 195 is uneven, or where the tubular is longitudinally curved rather than straight.

In some embodiments, the grinding of step 460 may begin without the idler wheel 170 being in contact with the surface of the work piece 195, but the idler wheel 170 may be positioned to engage the surface of the work piece 195 once the grinding wheel 125 has removed sufficient hardbanding from the surface of the work piece 195. Thus, step 460 performed during the grinding operation when the grinding wheel 125 is perpendicular to the longitudinal axis of the work piece 195, but not necessarily during the entirety of the grinding operation.

In instances where the grinding wheel 125 is perpendicular to the surface of the work piece 195 but not perpendicular to the longitudinal axis 199 of said work piece 195 (e. g. taper grinding), the idler wheel 170 may not be used to provide mechanical feedback to the grinding wheel 125.

While the disclosure has been described with reference to exemplary embodiments, it would be understood that various changes may be made and equivalents may be substituted for elements thereof without departing from the scope of the disclosure. In addition, many modifications will be appreciated to adapt a particular instrument, situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. An apparatus, comprising:

a front plate;

a support arm coupled to the front plate;

a linkage extending from the support arm;

a grinding wheel supported by the support arm;

an idler wheel assembly comprising:

a first structural element having a first end and a second end and coupled to the support arm along an edge between the first end and the second end;

a second structural element having a first end and a second end, where the first structural element is coupled at about its first end to the second structural element at about its first end;

a third structural element having a first end and a second end, where the first structural element is coupled at about its second end to the third structural element at about its first end and where the second structural element is coupled at about its second end to the third structural element at about its second end;

a distance adjustment element that screwably engaging the third structural element on its first end, wherein the adjustment of the distance adjustment element changes a distance between the second end of the first structural element and the second end of the second structural element;

an idler wheel coupled to the first end of the third structural element;

a piston rod coupled on a first end with the linkage; and a shock absorber slidably engaging a second end of the piston rod and coupled to the support arm.

2. The apparatus of claim 1, further comprising:

a linear actuator disposed between and coupled to the front plate and the linkage.

3. The apparatus of claim 2, wherein the linear actuator comprises:

a linear actuator base; and a linear actuator extension bar, wherein the linear actuator extension bar slideably engages and linear actuator base, which if configured to receive at least part of the linear actuator extension bar.

4. The apparatus of claim 1, further comprising:

a back plate disposed parallel to the front plate; and a fastener coupling the front plate to the back plate, wherein the front plate is rotatable relative to the back plate around the axis of the fastener.

5. The apparatus of claim 1, wherein the shock absorber comprises a pneumatic piston.

6. The apparatus of claim 1, further comprising:

a frame supporting the front plate and a work piece.

7. The apparatus of claim 6, further comprising:

an anti-walk wheel coupled to the frame and disposed to oppose lateral movement of the work piece.

8. The apparatus of claim 6, further comprising:

a lateral track, wherein the front plate is coupled to the lateral track and may slide relative along the lateral track.

* * * * *